US005256032A

United States Patent [19]

Dorsch

[11] Patent Number: 5,256,032

[45] Date of Patent: Oct. 26, 1993

[54] CENTRIFUGAL CHOPPER PUMP

[75] Inventor: Glenn R. Dorsch, Aberdeen, Wash.

[73] Assignee: Vaugan Co., Inc., Montesano, Wash.

[21] Appl. No.: 889,519

[22] Filed: May 26, 1992

[51] Int. Cl.[5] ..... F04D 29/70

[52] U.S. Cl. ..... 415/121.1

[58] Field of Search ..... 415/121.1, 206

[56] References Cited

U.S. PATENT DOCUMENTS

| | | | |
|---|---|---|---|
| 2,265,758 | 12/1941 | Klosson | 415/121.1 |
| 2,714,354 | 8/1955 | Farrand | 103/111 |
| 2,934,023 | 4/1960 | Lamkin et al. | 415/121.1 |
| 3,155,046 | 11/1964 | Vaughan | 103/103 |
| 3,325,107 | 6/1967 | Peterson | 241/101 |
| 3,340,812 | 9/1967 | Schlesiger | 103/103 |
| 3,444,818 | 5/1969 | Sutton | 103/111 |
| 3,447,475 | 6/1969 | Blum | 415/121.1 |
| 3,915,394 | 10/1975 | Ferguson, Jr. | 415/121.1 |
| 3,973,866 | 8/1976 | Vaughan | 415/121 |
| 4,378,093 | 5/1983 | Keener | 415/121.1 |
| 4,430,214 | 2/1984 | Baker | 415/121.1 |
| 4,527,947 | 7/1985 | Elliott | 415/121 |
| 4,575,308 | 3/1986 | Corkill | 415/213 |
| 4,842,479 | 6/1989 | Dorsch | 415/121.1 |

FOREIGN PATENT DOCUMENTS

| | | | |
|---|---|---|---|
| 729917 | 3/1966 | Canada . | |
| 2515411 | 10/1975 | Fed. Rep. of Germany | 415/121.1 |
| 759186 | 1/1934 | France | 415/121.1 |
| 1323707 | 6/1963 | France . | |
| 117094 | 9/1980 | Japan | 415/121.1 |
| 90951 | 11/1937 | Netherlands | 415/121.1 |
| 1332077 | 8/1987 | U.S.S.R. | 415/121.1 |
| 1551918 | 9/1979 | United Kingdom . | |

OTHER PUBLICATIONS

"General Notes on Adding an Integral Cutter to a Vaughan Cutter Bar in The Field," Vaughan Company, Inc., 1987.

*Primary Examiner*—John T. Kwon

*Attorney, Agent, or Firm*—Christensen, O'Connor, Johnson & Kindness

[57] ABSTRACT

A centrifugal pump has an open impeller with vanes having cutting edges at both the intake side of the pump bowl and the closed side of the bowl. The cutting edges of the vanes cooperate with narrow anvil ribs projecting inward from both sides of the pump bowl such that solid matter in the material being pumped is sliced and chopped inside the bowl. In addition, the intake end plate of the pump has an outer depression or recess with raised anvil ribs extending externally outward and cooperating with an additional external cutter received in the recess.

15 Claims, 6 Drawing Sheets

Fig. 5.
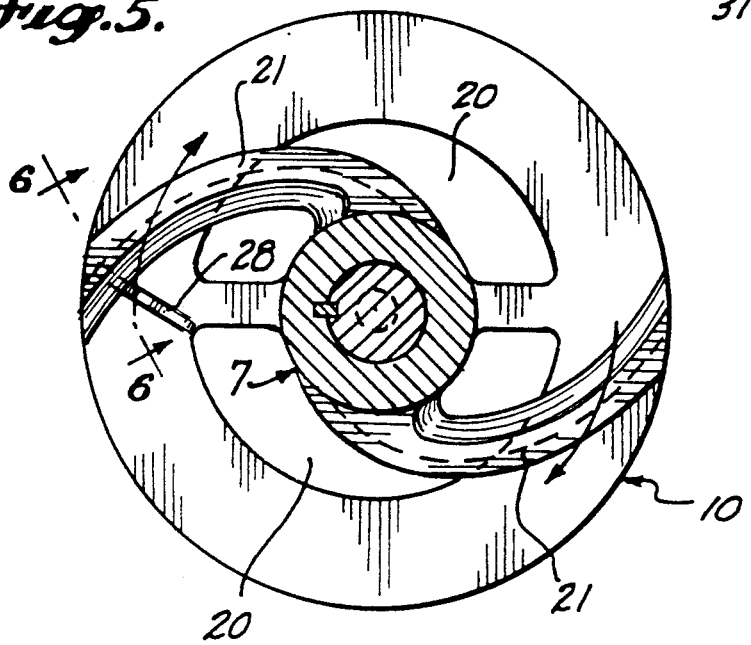
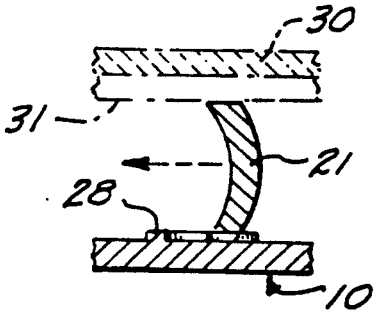
Fig. 6.
Fig. 7.
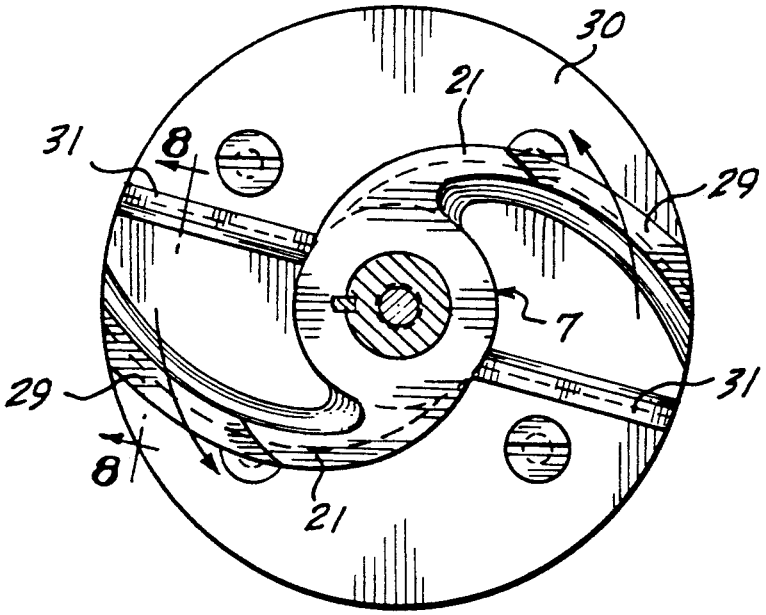
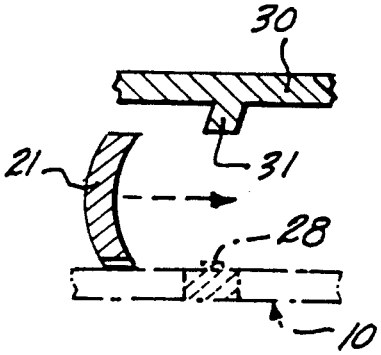
Fig. 8.

Fig. 10.
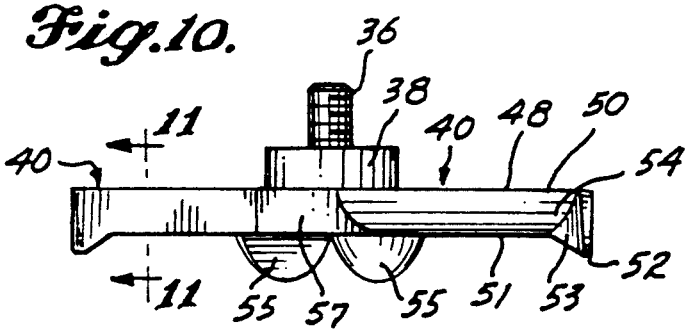
Fig. 11.
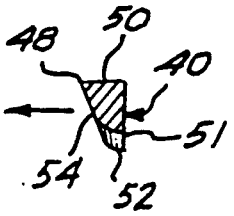
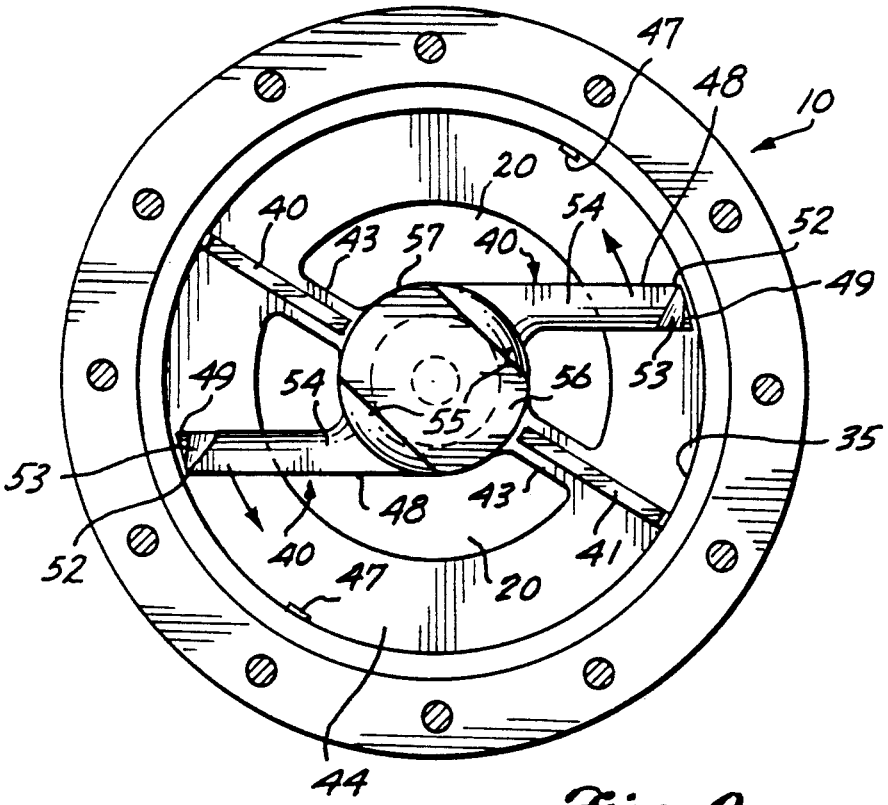
Fig. 9.

CENTRIFUGAL CHOPPER PUMP

FIELD OF THE INVENTION

The present invention relates to the general field of centrifugal pumps. More specifically, the present invention relates to a centrifugal pump effective for pumping liquids and slurries containing solid matter, including various types of refuse, and for chopping the solid matter which may thereafter be processed for disposal.

BACKGROUND OF THE INVENTION

Vaughan U.S. Pat. No. 3,155,046, issued Nov. 3, 1964, discloses a centrifugal pump having an open impeller with radial vanes. The vane edges adjacent to the pump inlet cooperate with sharpened edges of inlet apertures to cut stringy material or chunks entering the pump. Similarly, Vaughan U.S. Pat. No. 3,973,866, issued Aug. 10, 1976, and Dorsch U.S. Pat. No. 4,842,479, issued Jun. 27, 1989, disclose centrifugal pumps having impellers with vanes cooperating with inlet apertures to achieve a chopping or slicing action of solid material in a liquid or slurry being pumped. In the case of the pumps of Vaughan U.S. Pat. No. 3,973,866 and Dorsch U.S. Pat. No. 4,842,479, however, closed impellers having radial shroud plates are used; and external booster propellers are provided to accelerate flow into the pump, to displace chunks of solid matter which become lodged in the inlet apertures and, at least in some instances, to cut solid matter prior to entry into the pump.

Other types of pumps having external cutters rotated with an impeller or propeller are shown in Farrand U.S. Pat. No. 2,714,354, issued Aug. 2, 1955; Peterson U.S. Pat. No. 3,325,107, issued Jun. 13, 1967; and French Patent No. 1.323.707, issued Mar. 1, 1962.

Sutton U.S. Pat. No. 3,444,818, issued May 20, 1969, discloses another type of centrifugal pump having an internal impeller with vanes cooperating with the periphery of an inlet aperture to achieve a slicing action. In the Sutton construction, an outer "chopper member" has blades that wipe across the outer surface of the apertured intake plate to assist in chopping solid material to a size small enough to enter the intake aperture. Similarly, in the construction shown in British Patent No. 1,551,918, published Sep. 5, 1979, external blades sweep across small intake apertures to dislodge or gradually cut solid material clogging an intake aperture. In both the construction shown in the Sutton patent and the construction shown in the British patent, the external member is mounted so as to be moveable axially away from the intake plate if a hard obstruction is encountered.

Other types of pumps designed for pumping liquids or slurries containing solid materials are disclosed in Canadian Patent No. 729,917, issued Mar. 15, 1966; Schlesiger U.S. Pat. No. 3,340,812, issued Sep. 12, 1967; Elliot U.S. Pat. No. 4,527,947, issued Jul. 9, 1985; and Corkill U.S. Pat. No. 4,575,308, issued Mar. 11, 1986.

SUMMARY OF THE INVENTION

The principal object of the present invention is to provide a durable centrifugal pump effective for pumping liquids and slurries containing a large variety of solid refuse, including tough, resilient materials resistive to being cut and strong, stringy, fibrous or sinewy materials which may have a tendency to wind around and clog or impede rotating components in addition to being resistive to being cut.

In the preferred embodiment of the present invention, the foregoing object is accomplished by providing a centrifugal pump having an open impeller with vanes having cutting edges at both the intake side of the pump bowl and along the closed side of the bowl. At the intake side, the adjacent vane edges cooperate with intake apertures for a slicing or chopping action similar to some of the devices described above. However, the chopping effectiveness at the intake side is increased by providing at least one narrow internal anvil rib extending generally radially outward from the intake apertures to the circle defined by the free ends of the rotating impeller vanes. The radially outer portions of the impeller vanes are notched so as to pass closely over the anvil rib to achieve an internal cutting action at the intake side of the pump.

In addition, narrow anvil ribs are provided at the closed side of the pump bowl, opposite the intake side, for close cutting cooperation with the edges of the impeller vanes remote from the intake apertures. Therefore, solid matter is sliced and chopped as it enters the intake apertures, and also is sliced and chopped inside the bowl at both the intake side and the closed side during rotation of the internal impeller.

Further, the intake end plate of the pump has an outer depression or recess with the intake apertures being formed in the base of the recess. Raised anvil ribs extend across the base of the recess and in an axial direction along the peripheral portion of the recess. An external cutter rotated with the internal impeller has chopper blades which cooperate with such external anvil ribs for an exterior chopping action of matter which otherwise might become lodged in or adjacent to the intake apertures. The hub of the cutter has sharp teeth effective to chew through even tough, resilient or sinewy material and prevent such material from winding around the cutter.

BRIEF DESCRIPTION OF THE DRAWINGS

FIG. 5 is a section taken along line 5—5 of FIG. 2 (looking toward the pump intake) with parts deleted; and FIG. 6 is a section taken along line 6—6 of FIG. 5 with parts deleted.

FIG. 7 is a section taken along line 7—7 of FIG. 2 (looking away from the pump intake) with parts deleted and parts broken away; and FIG. 8 is a section taken along line 8—8 of FIG. 7.

FIG. 9 is an intake end elevation of the pump of FIG. 2, viewed from line 9—9 of FIG. 2, illustrating the external cutter of such pump;

FIG. 10 is a side elevation of such cutter removed from the pump; and

FIG. 11 is a section of such cutter taken along line 11—11 of FIG. 10.

DETAILED DESCRIPTION OF THE PREFERRED EMBODIMENT

Figure 1:
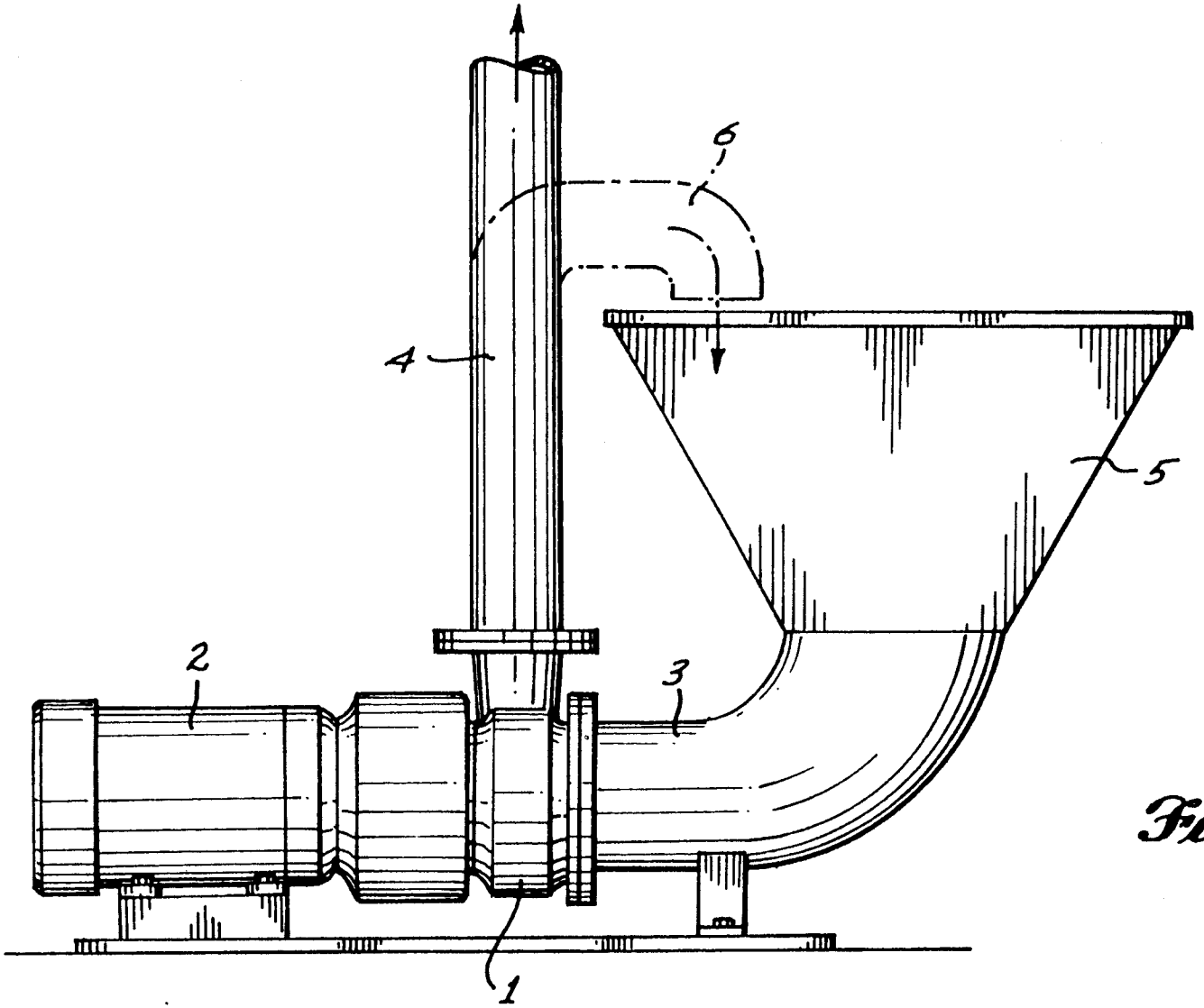
FIG. 1 is a side elevation of an installation of a centrifugal chopper pump in accordance with the present invention.

FIG. 1 illustrates a representative installation of a centrifugal chopper pump 1 in accordance with the present invention. Pump 1 has an internal impeller rotated about a horizontal axis by an appropriate motor 2 so as to draw matter axially into the pump through an intake pipe 3. Such matter is discharged generally tangentially of the impeller through an outlet pipe 4. Intake pipe 3 extends to a hopper 5 for receiving refuse to be chopped and pumped. The hopper is kept filled or partially filled with water to assist in the pumping action. The mixture of water and chopped refuse can be recirculated back through the pump by way of a return pipe 6 illustrated in broken lines in FIG. 1 until such time as the refuse has been chopped sufficiently for further processing or disposal.

It is important that the pump in accordance with the present invention be capable of pumping and chopping a wide variety of materials. For example, there has been concern over processing and disposal of medical waste which often is not sorted but which is simply collected in plastic garbage bags. Processing of the medical waste may be easier if the diverse materials could be pumped to a processing location or processing equipment, particularly if the materials were chopped efficiently. Representative of such materials are: bandages and dressings which may contain adhesives so as to stick and collect on surfaces with which they come in contact; synthetic rubber gloves or other items of resilient but tough materials resistant to puncturing and cutting; various types of sinewy nettings and gauzes, including stretch hosiery and fabrics which, if not cut or chewed effectively, tend to wind around and bind or impede rotating components; and various throwaway plastic items, including the sheet plastic garbage bags themselves. Bags of such materials can be loaded into the hopper 5 and the pump 1 in accordance with the present invention is effective to chop the solid matter into small pieces and discharge the mixture of solid matter and water through the outlet pipe 4.

Figure 2:
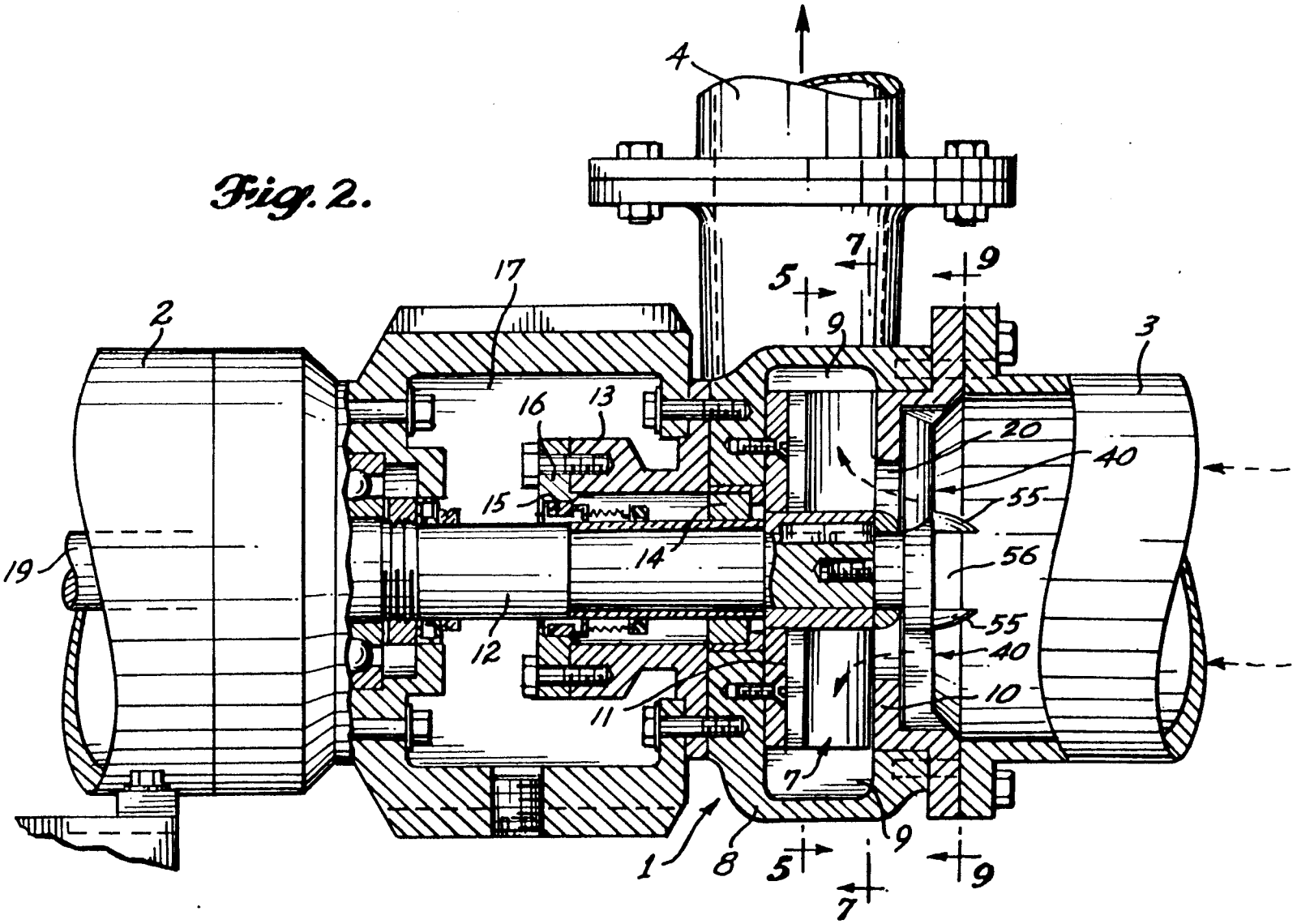
FIG. 2 is an enlarged side elevation of a centrifugal chopper pump in accordance with the present invention with parts broken away to reveal the interior of the pump bowl and adjacent structure.

The internal construction of the pump 1 in accordance with the present invention is shown in FIG. 2 along with adjacent components of the representative installation. The internal pump impeller 7 rotates in a generally cylindrical casing 8 defining a volute bowl 9 having an open side partially closed by an intake plate 10. Bowl 9 has a closed side 11 through which the impeller drive shaft 12 extends. Shaft 12 extends from the impeller through a stuffing box 13 of conventional design including a bushing 14 at one end, in which the drive shaft is journaled adjacent to the closed side of the pump bowl, and a mechanical seal 15 and gland ring 16 at the other end of the stuffing box. The stuffing box is enclosed in a packing housing 17. Outside the stuffing box, the impeller shaft 12 extends through conventional bearings 18 and is coupled to or integral with the motor output shaft 19. Rotation of the impeller 7 by its drive shaft 12 induces material to be sucked axially inward through intake apertures 20 of end plate 10. Such material is slung outward to the periphery of and circumferentially of the bowl 9 until it is discharged through the outlet pipe 4.

Figure 3:
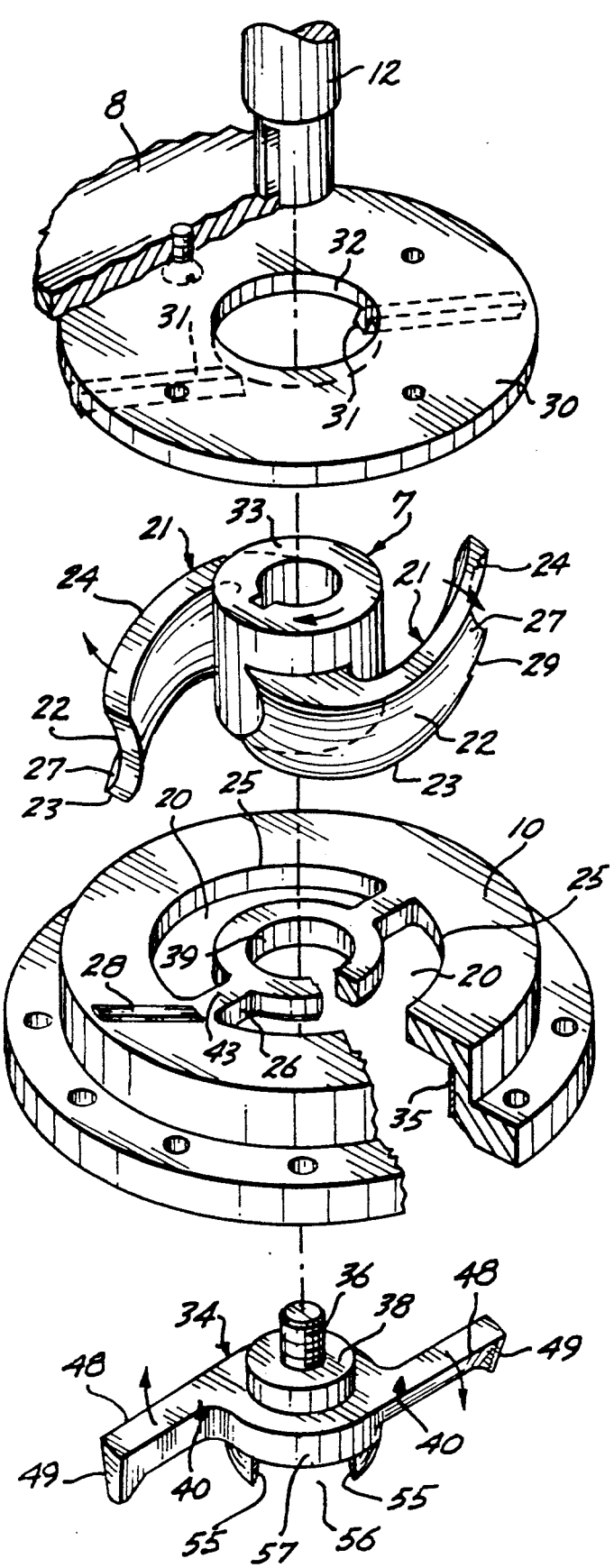
FIG. 3 is a fragmentary perspective of components of the pump of FIG. 2 taken from the closed side of the pump bowl, with parts shown in exploded relationship.
Figure 4:
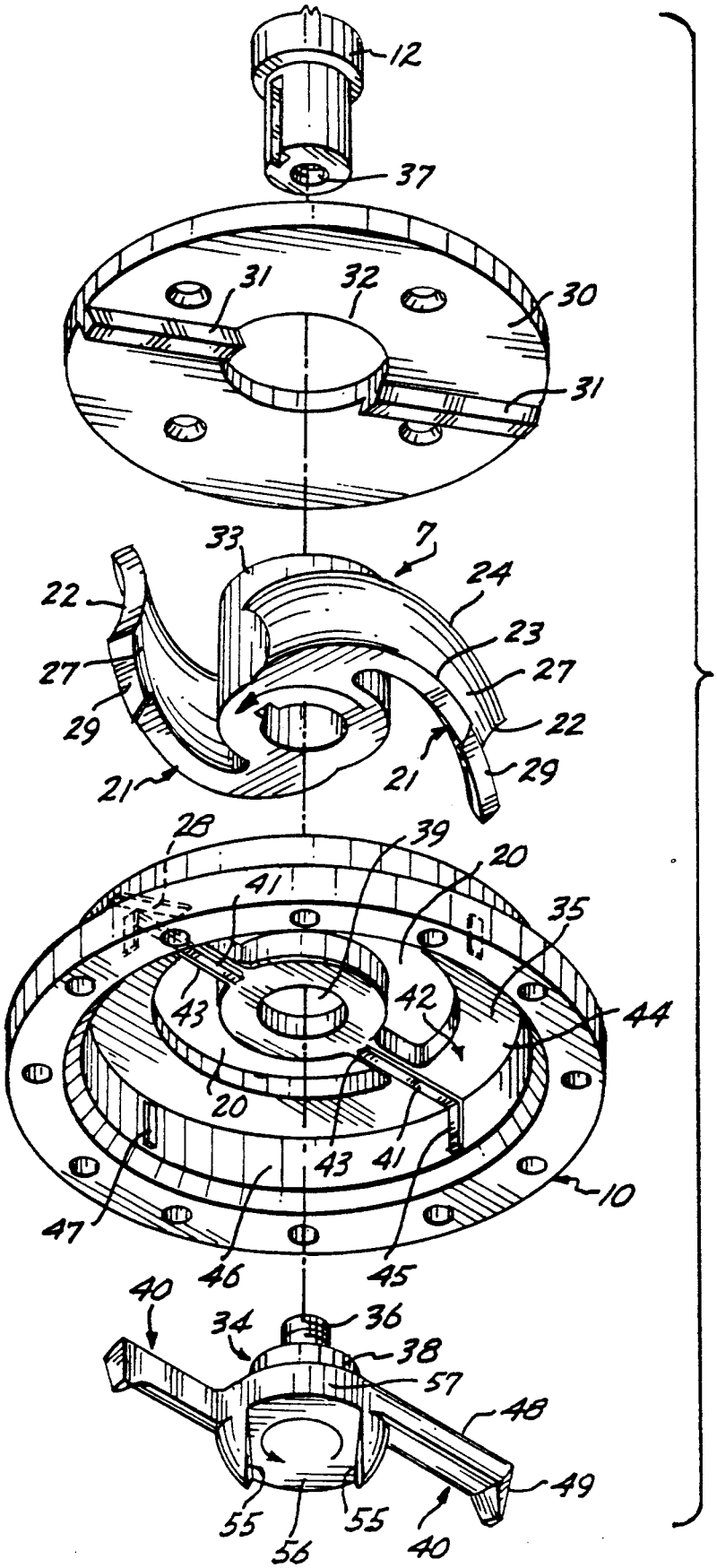
FIG. 4 is a corresponding perspective of such components but taken from the intake side of the pump.

The cooperating chopping components of the pump in accordance with the present invention are best seen in FIGS. 3 and 4. For internal chopping of solid matter in the liquid being pumped, the impeller 7 is of open design having two pumping vanes 21 spiralled rearward relative to the direction of rotation of the impeller. Each vane has a cupped leading face 22 such that both the intake edge 23 and opposite edge 24 of each blade are sharpened. The sharpened intake edge 23 of each impeller blade cooperates with the circumferential sides 25 and forward sides 26 of the arcuate intake apertures 20 for a slicing and cutting action of the type achieved in the pump of U.S. Pat. No. 4,842,479, for example. In addition, the free end portion 27 of each blade extends outward beyond the outer sides 25 of the intake apertures. In this radially outer zone, the inside of the intake plate 10 is provided with a short anvil rib 28 which projects from the otherwise planar inner surface of the intake plate exposed to the pump bowl. Such rib 28 is linear but does not extend precisely radially. From the inner end of the rib, the rib extends outward and forward relative to the direction of rotation of the impeller such that a blade tip portion slices gradually over the length of the rib as shown in FIG. 5. The tendency is to urge solid matter outward and circumferentially of the bowl toward the outlet as the material is sliced. Each blade has an end notch 29 so that the inner portion of the intake edge of the blade is in close cutting relationship to the inlet apertures while the outer portion passes closely along and over the anvil rib 28.

At the closed side of the pump bowl, a chopper plate or disk 30 is provided with at least one, preferably two, inward-projecting anvil ribs 31 best seen in FIG. 4. Disk 30 can be fastened to the closed side of the pump casing or ribs 31 can be cast or machined into the casing. Such ribs extend linearly outward from the central bore 32 which closely receives the hub 33. Preferably, ribs 31 extend almost radially such that the cutting edges 24 of the impeller blades which are swept rearward in the direction of impeller rotation pass closely across the ribs gradually from the radially inner portion of each blade toward its radially outer portion, as seen in FIG. 7, for an outward-directed slicing action at the closed side of the pump bowl. Again, the tendency is to force solid matter outward and circumferentially for passage to the pump outlet.

In addition to the cutting action achieved by cooperation of the intake edges 23 of the impeller with the sides of the intake apertures 20, the slicing action achieved inside the pump bowl by the notched tip portions 27 of the blades in combination with the abrupt intake side anvil rib 28 and the slicing action achieved at the closed side of the bowl by cooperation of the sharpened edges 24 of the impeller blades with the abrupt anvil ribs 31. Preferably the pump in the present invention also has an external cutter-chopper 34 coupled to and rotated with the impeller. In the preferred embodiment, the intake plate 10 has a cylindrical outward-opening depression or recess 35 in which the external cutter 34 rotates. Such cutter can have an externally threaded stud 36 for reception in an internally threaded end bore 37 of the impeller drive shaft 12 and a circular stepped hub 38 journaled in the central aperture 39 of the intake end plate 10. Cutter 34 has two blades 40 extending oppositely from the hub. Narrow anvil ribs 41 extend radially outward and project axially from the otherwise planar outer face 42 of the base of the end plate recess 35. Such ribs include inner portions extending across the joining sections 43 between the arcuate intake apertures 20 and outer portions extending across the unapertured annular portion 44 of the end plate surrounding the apertures. Such outer portions of the base ribs 41 lead to side ribs 45 extending axially along the peripheral wall 46 of the end plate depression and projecting abruptly radially inward. Preferably, additional side ribs 47 are spaced along such wall.

The external cutter blades 40 include linear sharpened leading edges 48 in close cutting relationship to the base ribs 41 as the cutter is rotated. In addition, each blade has an outturned tip or fin 49 extending generally perpendicularly from the radial portion of the blade and sharpened for cutting cooperation with the anvil ribs 45 and 47 spaced around the circumference of the end plate recess. As seen in FIG. 11, preferably the generally radially extending portions of the blades 40 taper in circumferential thickness from their edges 50 adjacent to the end plate to their edges 51 spaced outward therefrom. As seen in FIG. 9, the fins 49 taper in thickness from their base or root portions to their outer tips 52 and have inner surfaces 53 bevelled inward and rearward relative to the direction of cutter rotation. The angled leading faces 54 of the external cutter blades and the bevelled surfaces 53 of the fins help to clear material from the pump intake if such material does not readily pass into the pump through the apertures 20.

The external cutter 34 also includes an outer circular hub 57 of a diameter approximately equal to the inner diameter of the arcuate intake apertures 20. During manufacture, such hub is approximately hemispherical, but two axially extending teeth 55 are formed by cutting a wide groove 56 through the hub at an angle of approximately 45° relative to the direction of projection of each of the external cutter blades 40. The resulting teeth have sharp arcuate cutting edges that grind and chew through tough materials, particularly sinewy materials, and prevent such materials from winding around the external cutter and thereby blocking the intake apertures and/or impeding rotation of the cutter or the impeller.

The combined effect is to chew and grind solid matter by the external teeth 55, chop and slice such matter externally of the pump casing by the cutter 34 in cooperation with the base and side ribs 41, 45 and 47, and continue to slice and chop such matter inside the pump at both the intake side and the closed side of the pump bowl. Consequently, the pump in accordance with the present invention is effective to chop and pump a wide variety of refuse efficiently and without clogging.

The embodiments of the invention in which an exclusive property or privilege is claimed are defined as follows:

1. In a centrifugal pump having an impeller rotatable about an axis, a pump casing including a bowl receiving the impeller and having an inlet side for intake of material into the pump bowl and a closed side opposite the inlet side, the pump casing including an intake plate extending across the inlet side of the pump bowl, the improvement comprising the intake plate having an outward-opening recess, said recess including a base portion lying in generally a radial plane relative to the axis of rotation of the impeller and further including a peripheral wall portion, and an external cutter received in said recess and having at least one generally radially extending blade including a radially outer end portion, said cutter being rotated with the pump impeller, said intake plate including at least one external anvil rib projecting generally radially inward from the peripheral wall portion of the recess, said external anvil rib being in close cutting relationship to said blade of said external cutter as said cutter is rotated.

2. In a centrifugal pump having an impeller rotatable about an axis, a pump casing including a bowl receiving the impeller and having an inlet side for intake of material into the pump bowl, the pump casing including an intake plate extending across the inlet side of the pump bowl, the improvement comprising the intake plate forming an outward-opening recess, an external cutter received in said recess and having at least one generally radially extending blade, said cutter being rotated with the pump impeller, and at least one external anvil rib projecting abruptly into said recess, said external anvil rib being in close cutting relationship to said blade of said external cutter as said cutter is rotated.

3. In a centrifugal pump having an impeller rotatable about an axis, a pump casing including a bowl receiving the impeller and having an inlet side for intake of material into the pump bowl, the pump casing including an intake plate extending across the inlet side of the pump bowl and having an internal side adjacent to the impeller and an external side remote from the impeller, the improvement comprising the external side of the intake plate forming an outward-opening recess, an external cutter received in said recess and having at least one generally radially extending blade, said cutter being rotated with the pump impeller, and at least one external anvil rib projecting abruptly from the external side of the intake plate into said recess, said external anvil rib being in close cutting relationship to said blade of said external cutter as said cutter is rotated, the intake plate having an inlet aperture for entry of material into the pump bowl, the impeller having a blade including a cutting edge in close cutting relationship to the internal side of the intake plate adjacent to said aperture as the impeller is rotated.

4. In a centrifugal pump having an impeller rotatable about an axis, a pump casing including a bowl receiving the impeller and having an inlet side for intake of material into the pump bowl and a closed side opposite the inlet side, the improvement comprising the combination of the closed side of the pump bowl having at least one anvil rib projecting abruptly generally axially inward toward the impeller, and the impeller including at least one elongated vane having a first edge adjacent to the inlet side of the pump bowl and a second edge opposite said first edge, said second edge being adjacent to and in close cutting relationship to said rib as the impeller is rotated, the pump casing including an intake plate extending across the inlet side of the pump bowl, said intake plate having an inlet aperture for intake of material into the pump bowl through said aperture, said intake plate further having an outward-opening recess, said recess including a base portion lying in generally a radial plane and a peripheral wall portion, and including an external cutter received in said recess and having at least one generally radially extending blade, said cutter being rotated with the pump impeller, said intake plate including at least one external anvil rib projecting abruptly from the base of said recess, said external anvil rib being in close cutting relationship to said blade of said external cutter as said cutter is rotated.

5. In the pump defined in claim 4, at least one side anvil rib projecting generally radially inward from the peripheral wall portion of the recess and in close cutting relationship to the blade of the external cutter.

6. In the pump defined in claim 4, the external cutter having a central hub portion and including a plurality of teeth projecting generally axially outward from said hub portion.

7. In the pump defined in claim 6, the teeth having arcuate cutting edges.

8. In the pump defined in claim 4, the cutter blade having an edge adjacent to the intake plate and an edge remote from the intake plate and tapering in circumferential thickness from said edge adjacent to the intake plate to said edge remote from the intake plate.

9. In the pump defined in claim 8, the blade of the external cutter including a radially outer end portion, said radially outer end portion having a fin projecting generally axially outward away from the intake plate.

10. In a centrifugal pump having an impeller rotatable about an axis, a pump casing including a bowl receiving the impeller and having an inlet side for intake of material into the pump bowl and a closed side opposite the inlet side, the pump casing including an intake plate extending across the inlet side of the pump bowl, the improvement comprising the intake plate having an outward-opening recess, said recess including a base portion lying in generally a radial plane relative to the axis of rotation of the impeller and further including a peripheral wall portion, and an external cutter received in said recess and having at least one generally radially extending blade, said cutter being rotated with the pump impeller, said intake plate including at least one external anvil rib projecting abruptly from the base of said recess, said external anvil rib being in close cutting relationship to said blade of said external cutter as said cutter is rotated.

11. In the pump defined in claim 10, at least one side anvil rib projecting generally radially inward from the peripheral wall portion of the recess and in close cutting relationship to the blade of the external cutter.

12. In the pump defined in claim 10, the external cutter having a central hub portion and including a plurality of teeth projecting generally axially outward from said hub portion.

13. In the pump defined in claim 12, the teeth having arcuate cutting edges.

14. In the pump defined in claim 10, the cutter blade having an edge adjacent to the intake plate and an edge remote from the intake plate, and the blade tapering in circumferential thickness from said edge adjacent to the intake plate to said edge remote from the intake plate.

15. In the pump defined in claim 10, the blade of the external cutter including a radially outer end portion, said radially outer end portion including a fin projecting generally axially outward away from the intake plate.

* * * * *